United States Patent [19]

Kouno

[11] 4,421,450

[45] Dec. 20, 1983

[54] CARGO HANDLING APPARATUS

[76] Inventor: Toshio Kouno, c/o Dainichikiko Kabushikikaisha 774 Nakano, Ebina-shi, Kanagawa-ken, Japan

[21] Appl. No.: 351,971

[22] Filed: Feb. 24, 1982

Related U.S. Application Data

[63] Continuation of Ser. No. 903,828, May 8, 1978, abandoned.

[30] Foreign Application Priority Data

| | | | |
|---|---|---|---|
| May 13, 1977 | [JP] | Japan | 52-55713 |
| Aug. 3, 1977 | [JP] | Japan | 52-93162 |
| Aug. 30, 1977 | [JP] | Japan | 52-104462 |

[51] Int. Cl.[3] ..... B66F 11/00

[52] U.S. Cl. ..... 414/719; 414/680; 414/699; 414/917; 248/325; 254/124

[58] Field of Search ..... 414/744, 680, 719, 699, 414/728, 732, 735, 737, 742, 4, 5, 6, 738, 739, 708, 917; 254/124; 248/325, 123, 281; 137/458

[56] References Cited

U.S. PATENT DOCUMENTS

| | | | |
|---|---|---|---|
| 3,259,351 | 7/1966 | Olsen | 248/325 |
| 3,259,352 | 7/1966 | Olsen | 248/325 |
| 3,402,911 | 9/1968 | O'Neill | 248/325 |
| 3,721,416 | 3/1973 | Goudreau | 248/325 |
| 3,747,886 | 7/1973 | Carlson et al. | 248/325 |
| 3,883,105 | 5/1975 | Matsomoto | 254/124 X |

FOREIGN PATENT DOCUMENTS

| | | | |
|---|---|---|---|
| 1209308 | 10/1970 | United Kingdom | 414/917 |

*Primary Examiner*—Robert J. Spar
*Assistant Examiner*—Terrance L. Siemens
*Attorney, Agent, or Firm*—Murray Schaffer

[57] ABSTRACT

A parallelogram arm assembly having a vertical arm for suspending a load at lower end thereof and a pair of horizontal arms one of which is guided in a horizontal path is provided. The other horizontal arm is guided in a vertical path. The paths are defined in a supporting structure which is mounted rotatably on a standard or the like. Apparatus, such as a piston/cylinder actuator is provided for maintaining in cooperation with the parallelogram a floating balanced state of the arm assembly independently of the loaded or no-load state.

7 Claims, 22 Drawing Figures

CARGO HANDLING APPARATUS

This application is a continuation of Ser. No. 903,828, filed May 8, 1978, now abandoned.

BACKGROUND OF THE INVENTION

The present invention relates to a load handling apparatus which is adapted to carry, transport, position or manipulate weighty loads such as cargo, articles, goods, machines, tools or the like as desired, by a single operator with an extremely small external force by maintaining the load in a balanced floating state in which the load behaves as if it lies in a space where the influence of gravity is negligible. Such load handling apparatus is suited for use in factories, and warehouses where it is required to transport heavy articles of different weights, in repeated manner.

In load handling apparatus of the above type which apparatus is sometimes referred to also as a robot, two requirements are generally imposed. First, a substantially identical balanced state of the load handling apparatus has to be maintained independently of whether the apparatus is loaded or unloaded. Second, perfect controlability or manipulation of the load handling apparatus has to be attained. The hitherto known load handling apparatus or industrial robots do not satisfactorily meet these requirements.

SUMMARY OF THE INVENTION

An important object of the invention is to provide a novel and improved load handling apparatus which can maintain a load to be handled in a floating or balanced state independently of variations in the weight of the load, thereby assuring a high controlability in handling the load.

Another object of the invention is to provide a load handling apparatus which is capable of moving a load in any direction to a target position along the straight or shortest path.

Still another object of the invention is to provide a load handling apparatus which is capable of transporting any heavy load by a single operator with an extremely small external force.

According to the present invention, the load handling apparatus comprises a pair of horizontal arms disposed between a pair of spaced vertical walls. The arms are pivotably connected together to form a parallelogram by a vertically extending arm at one end and a link proximate the other end. The vertical arm being adapted to have a load secured or carried thereby. The link is guided relative to the side wall so that one of arms at that point moves in a horizontal direction while the other arm is provided with a counter weight, and there is an actuator such as a piston pivotally connected to it which moves the other arm at the point of connection in a vertical path. As a result of the cooperation of the actuator and the parallelogram structure a load is carried in balance.

Full detail of the present invention follows.

BRIEF DESCRIPTION OF THE DRAWINGS

Above and other objects, novel features and advantages of the invention will become more apparent from the detailed description of the preferred embodiments of the invention taken in conjunction with the accompanying drawings, in which.

DETAILED DESCRIPTION OF THE PREFERRED EMBODIMENTS

Figure 1:
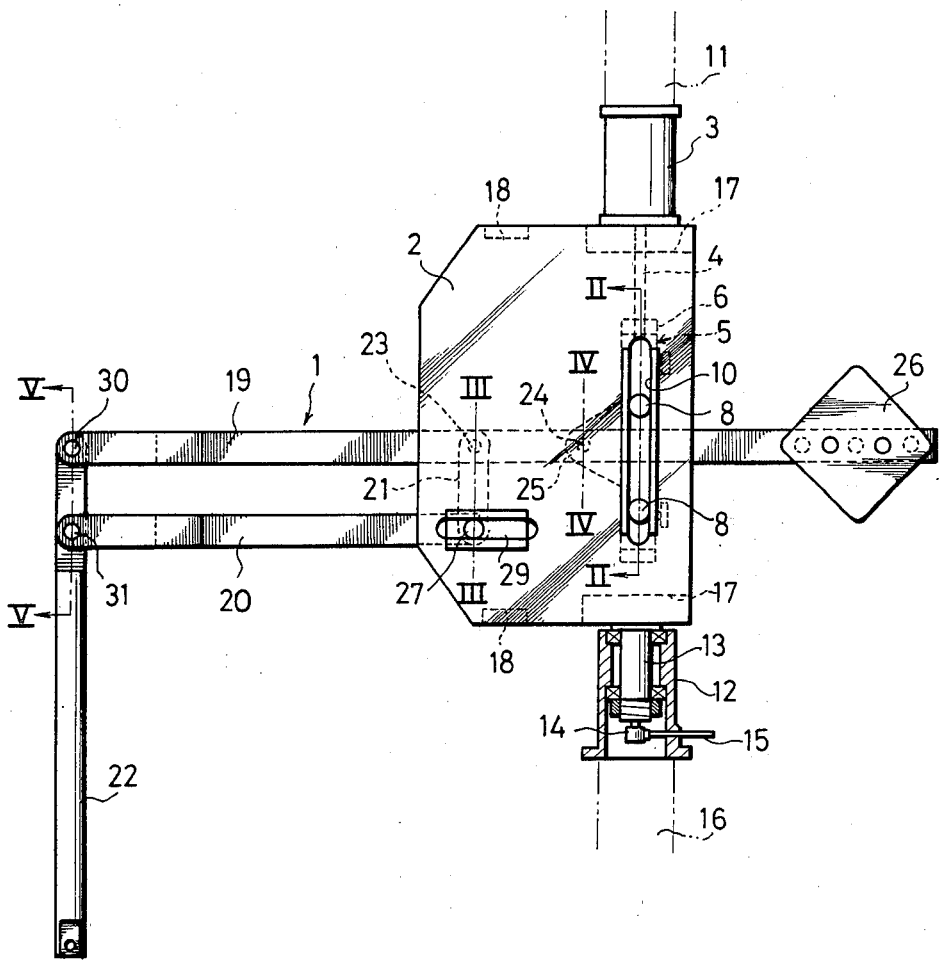
FIG. 1 is a schematic side view of a cargo handling apparatus according to an embodiment of the invention.

Now, the invention will be described in detail in connection with a first embodiment thereof by referring to FIG. 1 showing a side view thereof together with FIGS. 2 to 5 which are sectional views at various portions thereof. In the first place, it has to be noted that the term "cargo handling apparatus" as used herein is intended to mean not only the apparatus for handling or transporting cargos or goods in the inherent sense but also to encompass such apparatus for supporting and positioning various machines such as machine tools or the like. In this sense, the cargo handling apparatus according to the invention may be referred to also as a so-called industrial robot. In brief, the apparatus according to the invention is suited for handling, transporting, supporting and/or positioning any type of physical loads in general. Further, it should be mentioned beforehand that the cargo handling apparatus or industrial robot according to the invention may be installed movably or stationarily. For example, the apparatus may be mounted on a carriage adapted to be displaced along an overhead rail or ground rail or alternatively mounted on a stationary platform.

Referring to FIGS. 1 to 5, reference numeral 1 generally denotes a balancing mechanism or balancer which is mounted or supported by a supporting structure comprising a pair of vertically disposed plates 2 so as to be movable universally in three-dimensional directions. As a driving power source, there is mounted on the top side of the supporting structure or plates 2 a hydraulic cylinder 3 having a piston rod 4 which extends downwardly and has a lower end connected to a lift unit generally denoted by reference numeral 5. The lift unit 5 is constituted by top and bottom plates 6 connected together by side plates 7 in a rectangular frame-like configuration, as can be seen from FIG. 2. Each of the side plates is provided with a pair of guide rolls 8 in a vertical alignment with each other and rotatably supported by respective shafts 9 at the outer side of the associated side plate 7. The paired guide rolls 8 are respectively disposed slidably in vertical elongated slots 10 formed in the supporting plates 2, respectively.

The load handling apparatus can be mounted on an overhead carriage (not shown) by connecting the hydraulic cylinder 3 to a depending support leg 11 of the carriage as represented by a dotted broken line in FIG. 1 in any suitable manner. Of course, the apparatus may be mounted directly at a side of the carriage. In any case, in order to allow the balancer arrangement 1 to be rotated for 360° in a horizontal direction, a swivel bearing member 12 is provided at a bottom portion of the supporting structure 2 so as to rotatably support a rotatable shaft 13 connected to the latter. To control the rotation of the shaft 13, a swivel connector 14 is provided for the shaft 13 and is connected to a conduit 15 leading to a hydraulic control circuit which will be described hereinafter. Although the bearing unit 12 is disposed at the bottom of the supporting structure 2 in the case of the illustrated embodiment, it is equally possible to dispose the bearing unit 12 at the top of the supporting structure 2 in exchange for the cylinder 3.

In an alternative embodiment, the bearing unit 12 may be mounted on a base portion of a mounting bed or platform as suggested by dotted broken line 16, in the case where the cargo or load handling apparatus according to the invention is to be installed on the ground either stationarily or movably. In such case, the balancer 1 can be rotated for 360° around the rotatable shaft 13. In this manner, the load or cargo handling apparatus may be installed either on an overhead carriage or a ground platform movably or stationarily in accordance with practical application where the apparatus according to the invention is actually employed. The bearing unit 12 may be mounted either on the bottom or top of the supporting plate structure 2. To this end, mounting plates 17 and 18 are disposed at the bottom and the top of the mounting structure 2 to which the connecting shaft 13 may be selectively secured by conventional means such as bolts and nuts.

Figure 2:
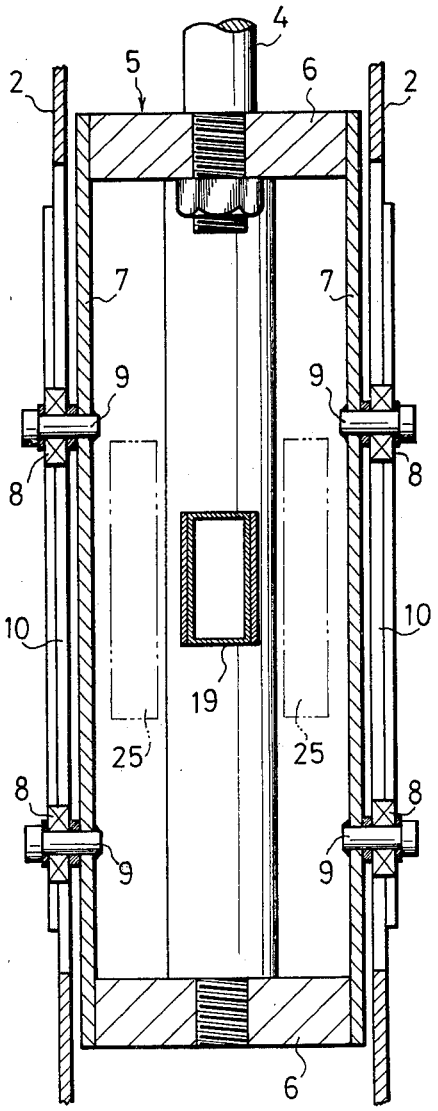
FIG. 2 is a sectional view of the same taken along line II—II in FIG. 1.
Figure 3:
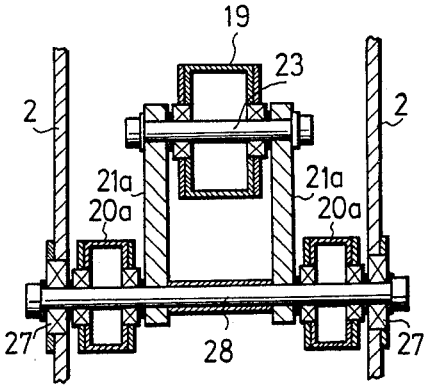
FIG. 3 is a sectional view taken along line III—III in FIG. 1.
Figure 4:
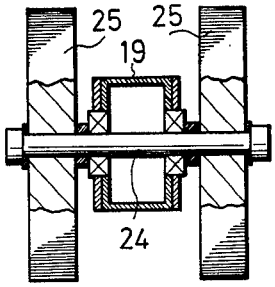
FIG. 4 is a sectional view taken along line IV—IV in FIG. 1.
Figure 5:
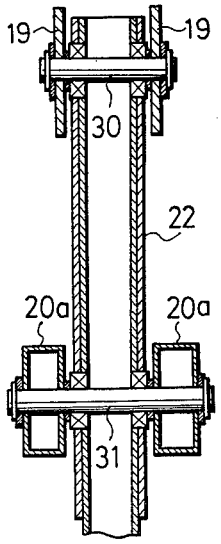
FIG. 5 is a sectional view taken along line V—V in FIG. 1.

The balancing apparatus or balancer 1 is constituted by an elongated horizontal arm 19, a lower arm 20 extending in parallel with the upper horizontal arm 19, a vertical link means 21 connected pivotally to both the arms 19 and 20 at the right end portions thereof as viewed in FIG. 1, and a vertical arm 22 also pivotally connected to the horizontal arm 19 and the parallel arm 20 at free end thereof, thereby to define as a whole, a parallelogram structure. The vertical arm 22 extends downwardly and has a lower end portion which is adapted to support a load such as cargo, goods, machines or tools. The front or left end portions as seen in FIG. 1 of the arm 19 is bifurcated for pivotal connection to the vertical arm 22. The lower arm 20 is in fact form by a pair of spaced members 22*a*, which are in unison and the link means 21 are also two spaced members 21*a*, as seen in FIG. 2.

The upper horizontal arm 19 extends rearwardly (to the right as viewed in FIG. 1) beyond the lower parallel arms 20 between the supporting side plates 2 and is supported pivotally by a pin 23 which serves to connect pivotally the upper end portions of the links 21 described above and a pin 24 which is mounted on supporting plates 25 each formed integrally with each of the connecting plates 7 constituting parts of the lift frame 5 described above. A counter weight 26 is adapted to be mounted on the extended end portion of the horizontal arm 19 at selectively variable positions.

A pin or shaft 28 pivotally mounted on the bifurcated rear end portion of the lower arm 20 extends rotatably through the lower end portions of the links 21 and with a spacer member disposed therebetween serves to support rotatably a pair of guide rolls 27 each of which is slidably fitted in a horizontally extending elongated slot 29 formed in each of the supporting side plates 2. Reference numerals 30 and 31 denote pins for connecting pivotally together the vertical arm 22, the horizontal arm 19 and the lower parallel arms 20 at the respective end portions.

With such arrangement of the cargo or load handling apparatus as described above, the pivotal shaft or pin 24 constitutes a primary fulcrum while the pivotal pin 23 constitutes a secondary or auxiliary fulcrum for the balancer 1 in operation thereof under actuation of the cylinder 3, whereby the load handling apparatus can move, transport or position a load such as cargo, machine, tool or the like to any desired place or location while being maintained in a balanced state over a whole range of operation.

Figure 6:
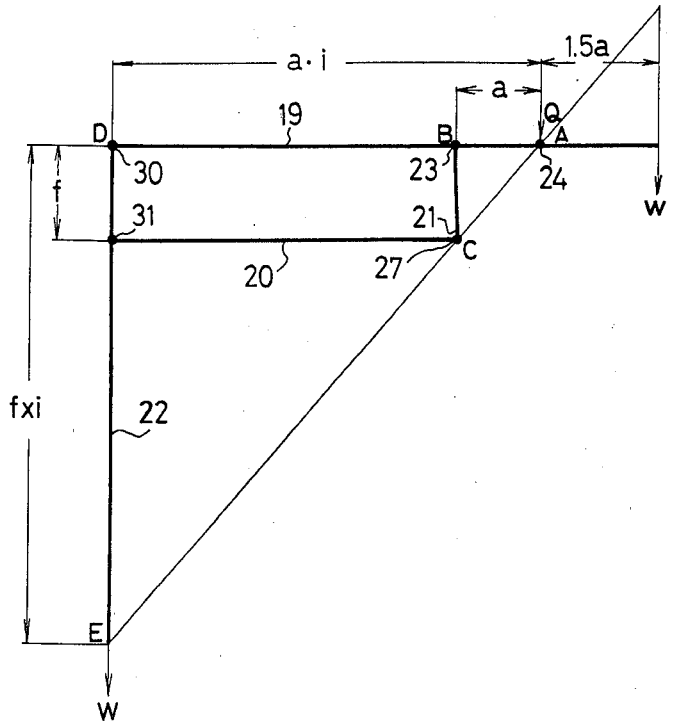
FIGS. 6 to 8 are schematic diagrams to illustrating the principles of operation a balancer arrangement employed in the cargo handling apparatus according to the invention.
Figure 7:
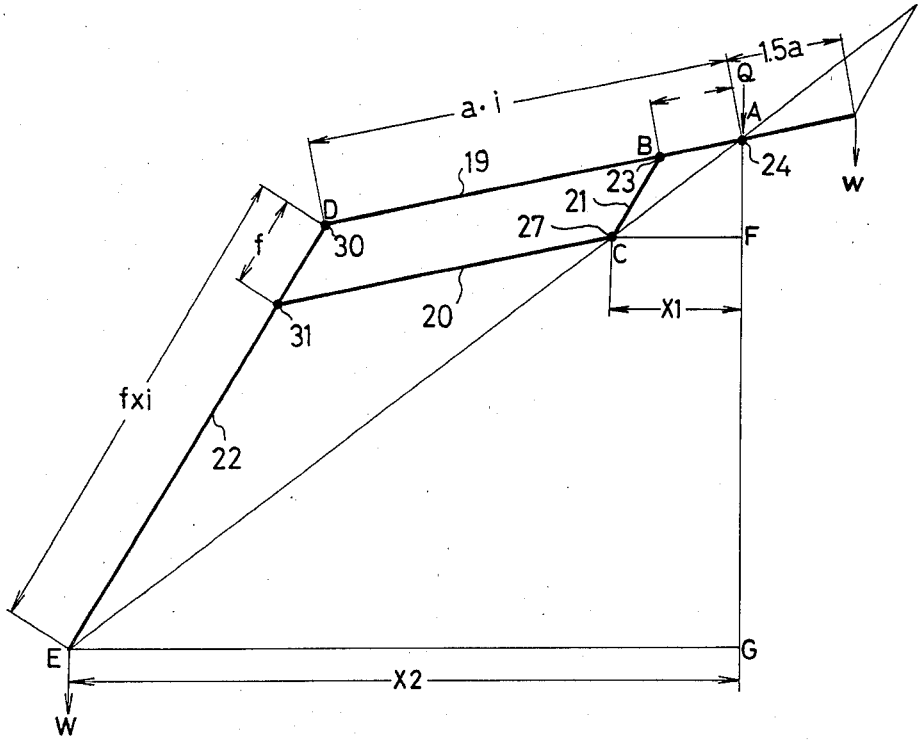
Figure 8:
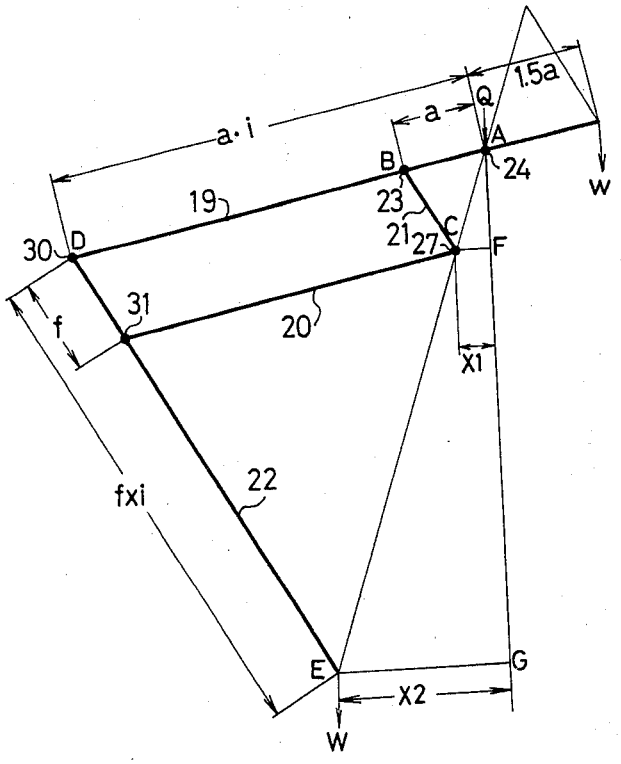

For example, when the cylinder 3 is actuated to move the lift member 5 upwardly, the supporting plates 25 are moved upwardly, as the result of which the horizontal arm 19 is caused to rotate in the counter-clockwise direction about the pivotal pin 24 as viewed in FIG. 1. In other words, the front end portion (left end portion as viewed in FIG. 1) of the horizontal arm 19 is lowered, accompanied by a downward movement of the vertical arm 22 to a position where a cargo or load to be transported can be held by a suitable means such as a hook or the like attached to the lower end of the arm 22. On the other hand, the upward movement of the vertical arm 22 can be assured by moving the lift frame 5 downwardly through corresponding actuation of the hydraulic cylinder 3. Additionally, in the stationary balanced state of the horizontal arm 19, it is possible to move the vertical arm 22 to the left or right as viewed in FIG. 1, since the parallel arm 20 can also be moved to the left or right swingably about the fulcrum constituted by the pivotal pin 28 by movement of the guide of the rolls 27 rotatably received in the horizontal slots 29 formed in the supporting side plates. In addition, the balancer apparatus 1 can be rotated for 360° about the connecting shaft 13 by virtue of the swivel bearing 12. In this manner, the vertical arm 22 can be moved universally in all the directions readily within a predetermined operating range, whereby a load or article suspended at the lower end of the vertical arm 22 can be transported or positioned to any desired place or location along the shortest path. The operating principle of such balancer arm arrangement 1 is illustrated in FIGS. 6 to 8. Referring to these figures, it is assumed that the weight of a load to be transported is represented by W, the thrust force of the cylinder 3 is represented by Q, the weight of the counter weight 26 is represented by w, and the ratio of length of the arms 20 and 22 to a distance a between the primary and the secondary fulcrums A and B is represented by i. In the state illustrated in FIG. 6, $$\Delta ABC \infty \Delta ADE$$

Thus, the moment at the point C can be given by $$Q \cdot a = W(ai - a) = Wa(i-1)$$

$$\therefore Q = W(i+1)$$

In the state represented in FIG. 7, $$\Delta ABC \infty \Delta ADE$$

Accordingly, $$\Delta ACF \infty \Delta AEG$$

$$\therefore x_2 = \alpha_1 \cdot i$$

The moment at the point C can be expressed by $$Qx_1 = W(x_2 - x_1) = W(x_1 i - x_1) = Wx_1(i-1)$$

Thus, $$Q = W(i-1)$$

In the state illustrated in FIG. 8, $$\Delta ABC \infty \Delta ADE$$

Accordingly, $$\Delta ACF \infty \Delta AEG$$

$$\therefore x_2 = x_1 \cdot i$$

The moment at the point C can be given by $$Qx_1 = W(x_2 - x_1) = W(x_1 i - x_1) = Wx_1(i-1)$$

Thus, $$Q = W(i-1)$$

As will be appreciated from the above analysis, the positions of the arms 20 and 22 will never exert any influence in the relation between the weight W of load to be transported and the thrust force Q of the cylinder, i.e. the relation $Q = W(i-1)$ at any states of the balancer 1. In other words, the balancer arrangement 1 can be constantly maintained at the balanced condition by producing a constant thrust force from the cylinders 3 which can be determined only on the basis of the weight W of the load to be transported independently from the movements of the vertical arm 22.

Figure 9:
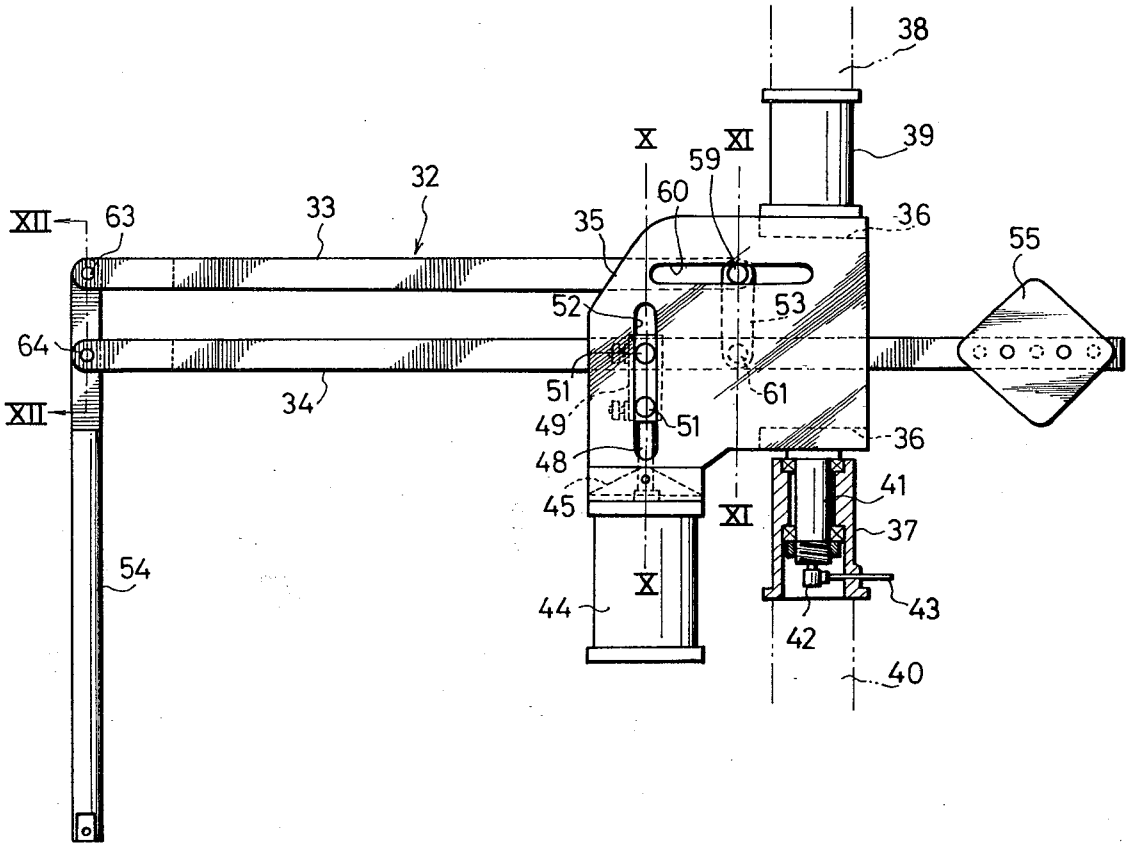
FIG. 9 is a schematic side view showing a cargo handling apparatus according to another embodiment of the invention.
Figure 10:
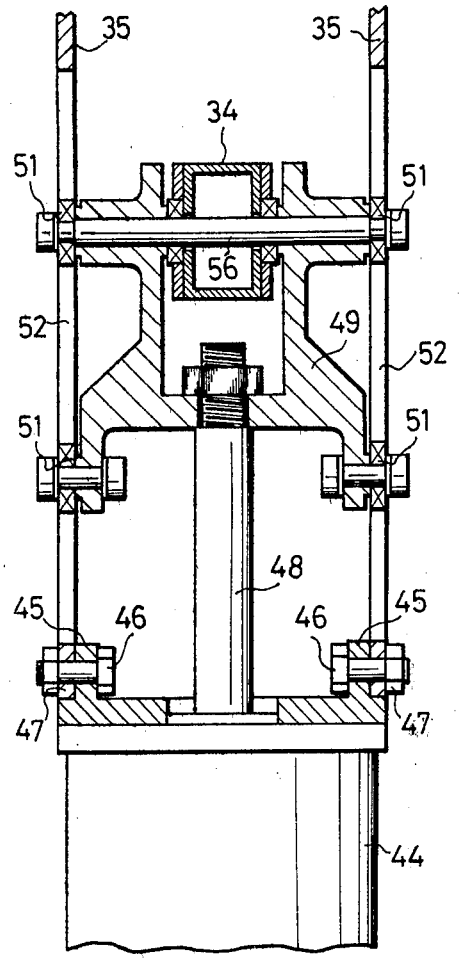
FIG. 10 is a sectional view of the same taken along line X—X in FIG. 9.
Figure 11:
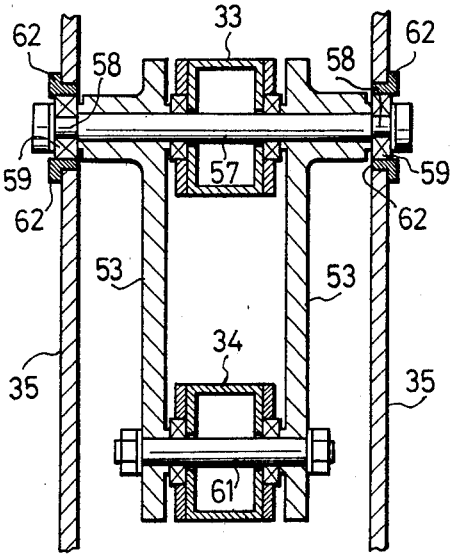
FIG. 11 is a sectional view taken along line XI—XI in FIG. 9.
Figure 12:
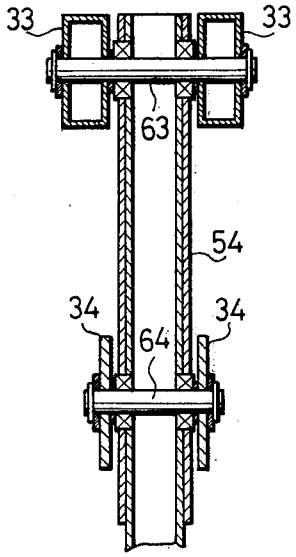
FIG. 12 is a sectional view taken along line XII—XII in FIG. 9.
Figure 13:
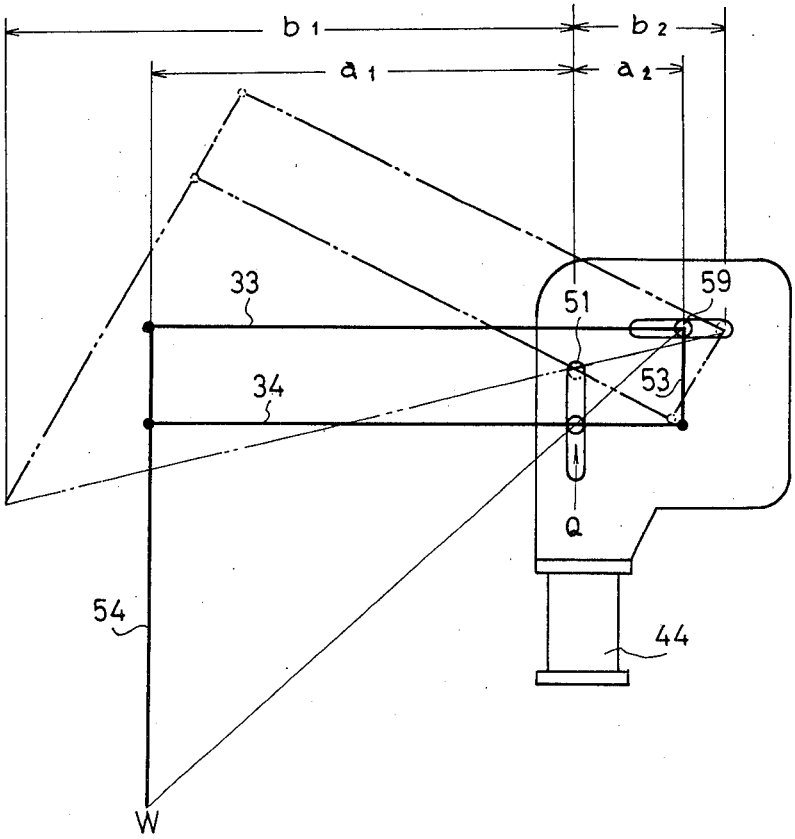
FIG. 13 is a schematic diagram to illustrating the principle of operation of a balancing arrangement employed in the cargo handling apparatus shown in FIG. 9.

Next, description will be made of the cargo or load handling apparatus according to a second embodiment of the invention by referring to FIG. 9 to FIG. 13 in which FIG. 9 is a side view of the same, while FIGS. 10 to 12 are sectional views taken along lines X—X, XI—XI and XII—XII in FIG. 9, respectively. FIG. 13 is a schematic diagram to illustrate the operation principle of the load handling apparatus shown in FIG. 9.

The balancer arrangement 32 of the load handling apparatus according to the second embodiment differs from the first embodiment described above in conjunction with FIGS. 1 to 8 mainly in that the positional relationship between the horizontal longer arm and the parallel arm is reversed. More specifically, the horizontally elongated arm 34 corresponding to the arm 19 of the first embodiment is positioned below the arm 33 corresponding to the arm 20 shown in FIG. 1. The rear end portions of these arms 33 and 34 are supported by supporting side plates 35 of a support structure which in turn is horizontally rotatably mounted on a swivel bearing 37 through a mounting plate 36 and a shaft 41. The swivel bearing 37 may be mounted on a ground platform 40. Alternatively, the load handling apparatus may be suspended on a movable carriage 38 on an overhead rail through a mounting member 39, as in the case of the first embodiment. A swivel connector 42 is provided for the rotatable shaft 41 for assuring rotation of 360° for the balancer arm structure. A conduit 43 is connected to the swivel connector 42 and leads to a hydraulic control circuit described hereinafter.

A hydraulic cylinder 44 is connected to the supporting side plates 35 through brackets 45 and clamped by means of bolts 46 and nuts 47, as can be clearly seen in FIG. 10. The cylinder 44 has a piston rod 48 extending upwardly and has a lift structure 49 mounted at the top end thereof. A pair of vertically aligned guide rolls 51 are mounted at each side of the lift structure 49 through a shaft 56 and adapted to be rotatably or slidably received in a vertical elongated slot 52 each formed in each of the support side plates 35.

The rear end portions (right end portions as viewed in FIG. 9) of the horizontally elongated arm 34 and the parallel arm 33 are pivotally connected to each other by means of vertical links 53, while the front bifurcated end portions of these horizontal arms 33 and 34 are pivotally connected to a vertical arm 54 extending downwardly and having suspending means such as hook, vacuum caps or the like mounted at the lower end.

The horizontal arm 34 extends rearwardly (to the right as viewed in FIG. 9) through the space defined between the supporting side plates 35. A counterweight 55 is mounted at the rear end of the arm 34 at adjustable positions. The horizontal arm 34 is further pivotally connected to the lift structure 49 at a substantially mid portion through the shaft 56. A pair of guide rolls 69 each disposed slidably in a horizontally extending slot 60 formed in each of the supporting side plates 35 are rotatably mounted on shafts 58 which may be provided separately or integrally from or with the shaft 57 which serves to pivotally connect the vertical links 53 to the parallel arm 33. The lower end portions of the vertical links 53 are pivotally connected to the horizontally elongated arm 34 through a pivotal shaft 61. Reference numeral 62 designates guide tracks for restricting vibrations of the parallel arm, while numerals 63 and 74 denote pivotal shafts or pins for connecting pivotally the bifurcated front end portions of the arms 33 and 34, respectively to the vertical arm 54.

With the above arrangement of the load handling apparatus, manipulation of the balancer arm assembly 32 can be made universally in all directions with extremely small external force particularly under no-load condition by virtue of the fact that a triangle formed by the horizontal arm 34, the vertical arm 54 and a line passing through the upper guide roll 51 driven by the cylinder 48 and the load suspending point at the lower end of the vertical arm is constantly in similitude with a triangle formed by the parallel arm 33, the vertical arm 54 and a line passing through the guide roll 59 and the load suspending point. More specifically, when dimensions $a_1$, $a_2$, $b_1$, $b_2$ shown in FIG. 13 is used, the following expression is always valid:

$$a_1/a_2 = b_1/b_2 = \ldots = i$$

where i represents a constant.

Accordingly, the thrust force Q of the cylinder 44 is given by $$Q = a_1/a_2 \cdot W$$

where W represents the weight of a load to be handled. It is thus apparent that the thrust force Q of the cylinder 44 which is required for maintaining the load handling apparatus shown in FIGS. 9 to 13 is definitely determined only by the weight W of load independently of positions taken by the arms 33, 34 and 54. Further, the movement of the lower end of the vertical arm 54 will follow the shortest straight path due to the above described and illustrated arrangement of the guide slots 52 and 60.

Next, description will be made of the hydraulic or fluid control circuit system for actuating the cylinder 3 or 44. This will be described by referring to FIGS. 14 to 22 with the assumption that the cylinder 3 is mounted under the side plates 2.

Figure 14:
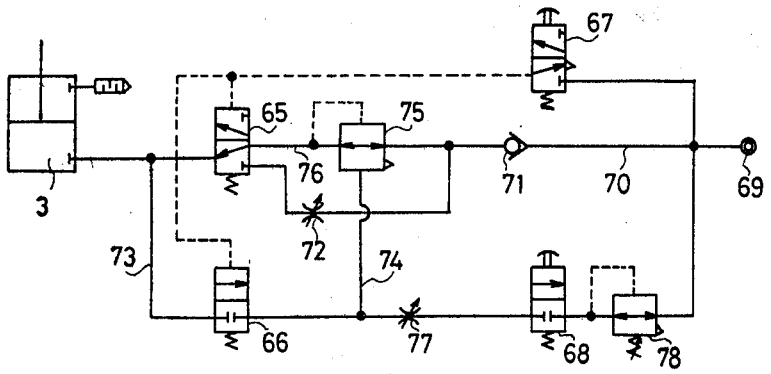
FIGS. 14 to 22 are circuit diagrams showing various hydraulic control circuits which can be employed in combination with actuator cylinders used in the cargo handling apparatus according to the invention.

Referring to FIG. 14 which shows a fluid control circuit adapted for automatically detecting the weight of load under load condition of the cargo handling apparatus, adjusting the fluid pressure within the cylinder 3 in accordance with the detected load weight, storing the adjusted pressure, and sensing automatically variation in the fluid pressure thereby to effect an automatic control, reference numerals 65 and 66 denote pilot actuation valves, 67 designates a manually operated valve and 69 denotes a fluid pressure source. Starting from the state in which a load is attached at the lower end of the vertical arm 22; when the manual valve 67 is opened it thereby makes the pilot actuation valves 65 and 66 connect to the valve 67, a pressure fluid which may be a gas such as air or liquid such as oil will then flow from the pressure source 69 through a conduit 70, a check valve 71, a throttle valve 72 and an actuator valve 65 into a lower chamber of the cylinder 3. As a result the lift structure 5 is moved upwardly through the piston rod 4 at a speed regulated by the throttle valve 72, whereby the load moves into a suspended state. Simultaneously the fluid pressure within the lower chamber of the cylinder which is required to sustain the load in the suspended state is applied to a pilot port of a pilot regulator 75 through the pilot valve 66 provided in a branch circuit 73 and a conduit 74, whereby the weight of the load is sensed and a corresponding fluid pressure is supplied from the pressure source 69 to maintain the balanced state under the load condition.

When the load to be transported is in a floating state at a desired height under the balanced condition, the manually operated valve 67 is closed thereby to close the actuation valves 65 and 66 and stop the supply of pressure medium to the cylinder 3. The upward movement of the lift structure 5 is then stopped. On the other hand, the fluid pressure fed to the pilot port is blocked by the pilot actuation valve 66 and the manual valve 67, whereby a fluid pressure controlled so as to be equal to the blocked fluid pressure is produced at the secondary side of the pilot regulator 75. Under this pressure, the fluid will flow through the path 76 and the actuation valve 65 into the lower chamber of the cylinder 3, as the result of which the load becomes stationary in the suspended and balanced state which facilitates the manual positioning of the suspended load. When a manual effort is applied to the stationary load W for a fine adjustment of position, a pressure variation of a small magnitude $\pm\Delta P$ will occur in the lower chamber of the cylinder 3 and is added to the pressure prevailing at the secondary side of the pilot regulator 75. Consequently, the suspension of the load is maintained by the pressure at a level equal to that of the fluid pressure confined in the pilot port during the manual movement of the load, while pressure increment $+\Delta P$ is discharged externally through a relief port of the pilot regulator. On the other hand, for the pressure decrement $-\Delta P$, a corresponding flow of pressure fluid will occur from the primary side to the secondary side of the pilot regulator. In this manner, a constant pressure is maintained regardless of the position of the piston in the cylinder 3, whereby the established balance state is maintained during the manual operation and thus the load can be transported to a desired position safely and accurately with an extremely small manual force.

After the work has been completed, the manually operated valve 68 is opened thereby to exhaust the pressure from the pilot port of the pilot regulator 75 into the path 74 and hence discharge externally of the control circuit through the throttle valve 77, the manually operated valve 68, the pilot regulator 78 adapted to be operated under no-load condition and the relief port. The throttle valve 77 serves then to regulate the speed of the piston rod 4 on moving downwardly while the regulator 75 functions to adjust the pressure within the lower chamber of the cylinder so as to be equal to the pressure under no-load condition. The check valve 71 serves to protect the piping from being damaged when the pressure source 69 is interrupted and additionally to prevent the vertical arm 22 from moving downwardly under gravity which would otherwise be caused by possible displacement of the piston in the cylinder 3.

Figure 15:
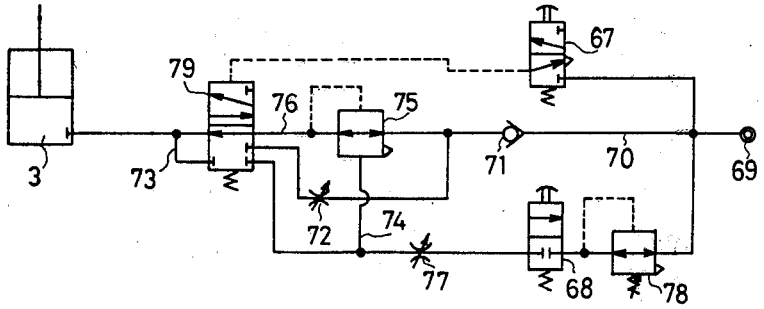

The control circuit shown in FIG. 15 differs from the one shown in FIG. 14 in that the pilot actuation valves 65 and 66 are replaced by a single actuation valve 79, with the other arrangement remaining same.

Figure 16:
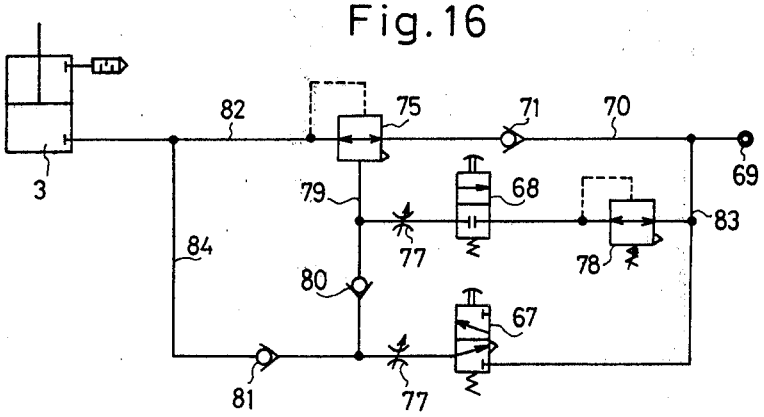

Referring to FIG. 16 which shows another embodiment of the fluid control circuit for the load handling apparatus, when the manually operated valve 67 is opened, the fluid pressure from the pressure source 69 is supplied to the lower chamber of the cylinder 3 through the circuit path 70, the throttle valve 71, pilot regulator 75, a circuit path 79 connected thereto and the check valves 80 and 81, as the result of which the piston rod 4 of the cylinder 3 is caused to move upwardly under the load condition. At that time, the pressure in the lower chamber of the cylinder 3 becomes equal to the pressure prevailing in the pilot port of the pilot regulator 75. Upon closing the manually operated valve 67, the pressure in the lower chamber of the cylinder 3 is maintained equal to the pressure in the pilot regulator 75 through the check valves 80 and 81, whereby the pressure under the load condition is sensed. When a manual force is applied to the suspended load, slight pressure changes $\pm\Delta P$ will occur and the pilot regulator 75 connected to the lower chamber of the cylinder 3 through a conduit 82 will be operated, whereby a constant pressure is maintained regardless of operation of the cylinder 3. In other words, the balanced state is established and maintained under the load condition.

When the other manually operated valve 68 is set to the open position, the pressure established at a relief regulator 78 provided in the path 83 branched from the conduit and reduced to the no-load pressure level will be fed to the lower chamber of the cylinder 3 through the throttle valve 77, conduit 79, check valves 80 and 81 and the path 84, thereby to cause the piston rod 4 to move downwardly. Finally, the manually operated valve 68 is closed, thereby to maintain the balanced state under the no-load condition.

Figure 17:
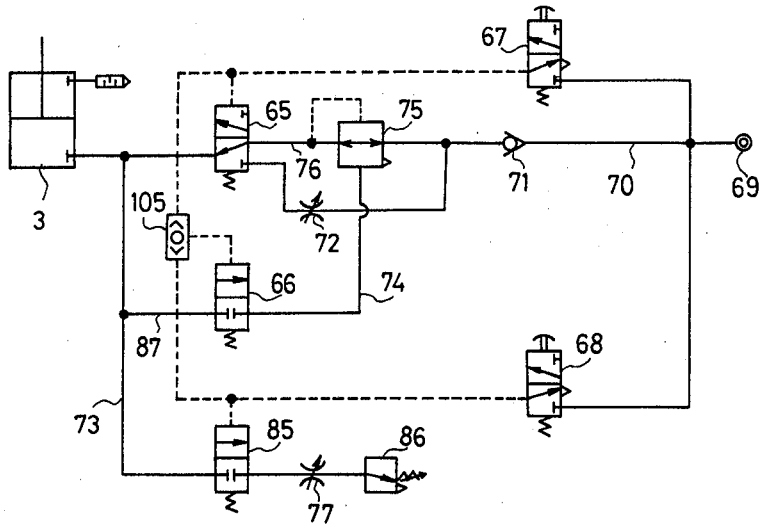

FIG. 17 shows another embodiment of a fluid control apparatus of an automatic detection type. The flow direction of pressure medium as well as various operations brought about by opening the manually operated valves 67 and 68 are same as those of the first embodiment shown in FIGS. 14 and 15. Difference resides in the circuit arrangement for maintaining the balanced state under the no-load condition, which will be described below. When the manually operated valve 68 is opened thereby to open the pilot actuation valves 66 and 85 connected to the valve 68, the fluid pressure will be discharged externally of the circuit from the relief valve which is set at a pressure for maintaining the balanced state under the no-load condition after flowing through the conduit 73, pilot actuation value 85 and the throttle valve 77. When the pilot actuation valve 66 disposed in the path 87 branched from the conduit 73 is opened concurrently, the fluid pressure in the pilot port of the pilot regulator 75 will be discharged externally of the control circuit through the valve 66, whereby the pressure required under the no-load condition will be attained. When the manually operated valve 68 is closed, the pressure in the lower chamber of the cylinder 3 will become equal to the pressure in the pilot port, whereby the balanced state, under the no-load condition will be produced.

Figure 18:
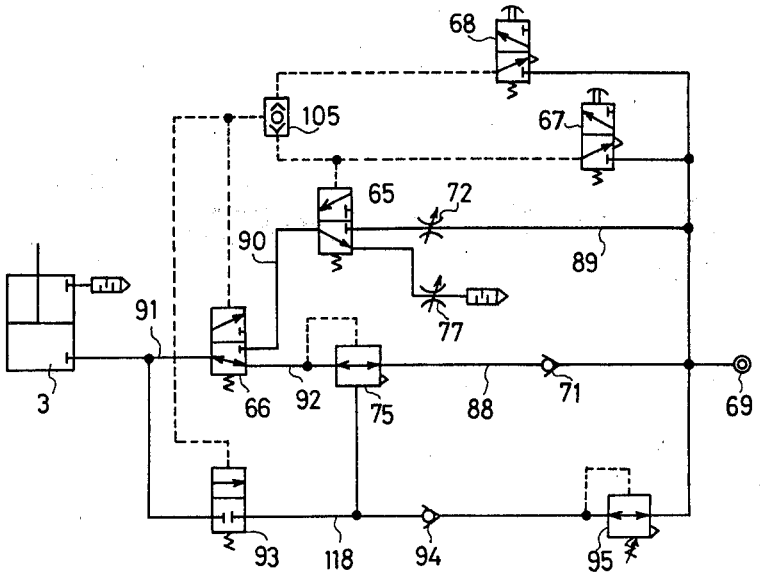

FIG. 18 shows a fifth embodiment of the fluid control circuit. When the manually operated valve 67 for the loaded condition is opened and the pilot actuation valves 65 and 66 provided in the conduits 88 and 89 leading to the pressure source 69 are opened, the fluid pressure is fed to the lower chamber of the cylinder 3 from the pressure source 69 through the conduit 89, throttle valve 72, actuator valve 65, conduit 90, actuator valve 66 and the conduit 91, whereupon the piston rod 4 is caused to move upwardly at a speed regulated by the throttle valve 72 thereby to move the lift structure 5 and hence the vertical arm 22 upwardly. Concurrently, the fluid pressure prevailing in the lower chamber of the cylinder which is required for suspending the load is fed to the pilot port of the pilot regulator 75 through the conduit 91 actuator valve 66 and the conduit or path 92 thereby to sense or detect the weight of the load, which in turn results in the supply of a corresponding fluid pressure from the pressure sounce 69 to maintain the balanced state under the load condition. When the manually operated valve 67 is closed in this state, the valves 65, 66 and 93 will be closed to stop the operation of the cylinder 3 and at the same time a pressure equal to that of fluid confined in the pilot port of the pilot regulator 75 through the actuation valve 93 and the check valve 94 will be produced at the secondary side of the pilot regulator 75 and then fed to the lower chamber of the cylinder 3 through the actuator valve 66 and the conduit 91 thereby to maintain the load in the balanced suspended state. In this balanced state, the load can be transported to any desired position with an extremely small manipulating force independently from the positions of the piston in the cylinder 3, as is in the case of the preceding exemplary embodiments.

When the manually operated valve 68 for the no-load condition is opened thereby to open the actuator valves 66 and 93, the fluid pressure within the lower chamber of the cylinder 3 will be discharged externally of the control circuit through the conduit 91, actuator valves 66, conduits 92 and 65 and the throttle valve 77 which serves then to regulate the speed of the piston rod 4 moving downwardly. The pressure within the cylinder 3 is then progressively decreased as being accompanied by reduction of pressure within the pilot port of the pilot regulator 75. Then, the valve 68 is closed thereby to establish the balanced state under the no-load condition. It will be noted that, although the pressure in the pilot port is blocked by the closed actuator valve 93, a regulated constant pressure is produced through the pilot regulator as provided in the conduit 118 interconnecting the actuator valve 93 and the pressure source 69. Under this regulated constant pressure, the balanced state under the no-load condition can be maintained.

Figure 19:
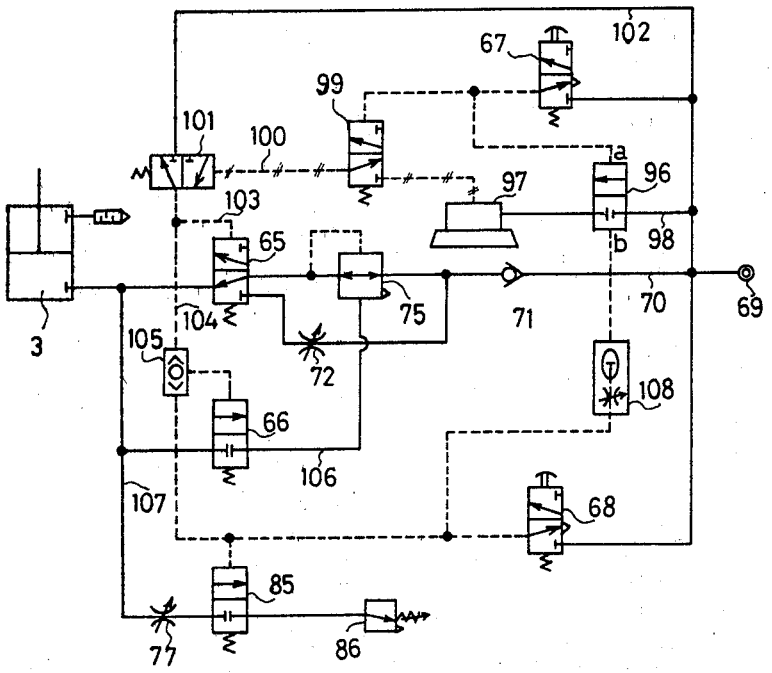

It has been described that the depending lower end of the vertical arm 22 of the balancer arrangement 1 is adapted to be attached with a load to be moved through a conventional means such as hook. However, in place of such suspending or hanging means, it is also possible to use vacuum suction means such as vacuum suction cups. FIG. 19 shows a fluid control circuit of an automatic detection type incorporating such vacuum suction means. Referring to this figure, when the manually operated valve 67 is opened and the pilot actuation valve 96 connected thereto is changed over to the position a, pressurized air from the pressure source 69 is introduced to an ejector 97 through the conduit 98, thereupon the vacuum suction is initiated. When the pilot actuation valve 99 is simultaneously opened, air pressure will exceed the vacuum pilot pressure in the conduit 100. When the vacuum exceeds the level set in dependence on a load to be handled, a vacuum operated valve 101 is opened, as the result of which the load is subjected to the suction. Subsequently, the fluid pressure of the pressure source 69 will transmitted to the pilot actuation valve 65 by way of the conduit 102, valve 101 and the conduit 103 and additionally fed to the pilot actuation valve 66 to open it by way of the conduit 104 and a shuttle valve 105. The fluid pressure is then supplied to the lower chamber of the cylinder 3 through the throttle valve 72, whereby the cylinder 3 is actuated to press the piston rod 4 upwardly for a desired distance under the load condition. Concurrently, the pressure at a level equal to that of the pressure in the lower chamber of the cylinder 3 is fed to the pilot port of the pilot regulator 75, thereby to establish the balanced state under the load condition. When the actuation valve 67 is closed, the valve 99 connected thereto is also closed, which results in that the valve 96 is self-held at the side a to maintain the suction. Further, when the vacuum operated valve 101 is closed due to communication of the vacuum pilot pressure with exterior and hence the actuation valves 65 and 66 are closed; the fluid pressure in the pilot port of the pilot regulator 75 is blocked at the pressure equal to the one prevailing in the lower chamber of the cylinder in dependence on the load. Consequently, the balancer 1 becomes stationary in the balanced suspended state under the load condition.

When the manually operated valve 68 is opened thereby to make conductive the pilot actuation valves 66 and 85 connected thereto, the fluid pressure in the pilot port is discharged externally of the control system through the relief valve 77 set at a pressure corresponding to the no-load condition, the conduit 106, actuation valve 66, conduit 107, throttle valve 77 and the actuator valve 85, thereby to establish the balanced state under no-load conditions. By connecting a delay valve 108 between the valves 68 and 96, the valve 96 may be changed over to the side b after the elapse of delay time set at the valve 108, thereby to stop the air supply to the ejector 97. The suction is thus terminated.

Figure 20:
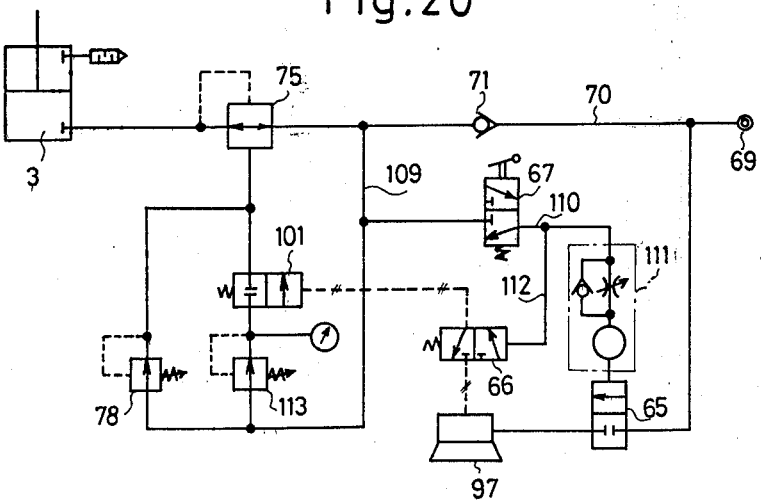

FIG. 20 shows a pressure regulation type fluid control circuit incorporating therein a vacuum suction feature. When the manually operated valve 67 is opened, the fluid pressure from the pressure source 69 is applied to the pilot actuation valve 65 and hence to the ejector 97 to initiate the suction after having passed through the conduit 70, the branched path 109, valve 67, conduit 110 and the delay valve 111. In this case, the delay circuit 111 is prevented from operation by the check valve 71 disposed in the path 70. Simultaneously, the pilot actuation valve 66 provided in the flow path 112 branched from the conduit 110 is opened, whereby the vacuum pilot pressure may be transmitted through the actuator valve 66. If this vacuum pilot pressure is greater than the preset vacuum pressure, the vacuum operated valve 101 is opened to effect the suction for the load. When the fluid pressure from the pressure source 69 is fed to the pilot port of the pilot regulator 75 through the flow paths 70 and 109 and the regulator 113 set at a pressure level corresponding to the load weight due to the suction, a pressure equal to the pilot pressure will be produced at the secondary side of the pilot regulator 75, whereby the balancer 1 becomes stationary in the balanced state under the load condition.

When the valve 67 is subsequently closed, the actuator valve 66 as well as the vacuum operated valve 101 will also be closed. The pressure level set by the regulator 113 is sustained in the pilot port, whereby the balanced state under no-load conditions can be maintained. Upon closing of the actuator valve 65 after elapse of delay time set in the delay circuit 111, the air supply to the ejector will be interrupted to terminate the sucking action.

Figure 21:
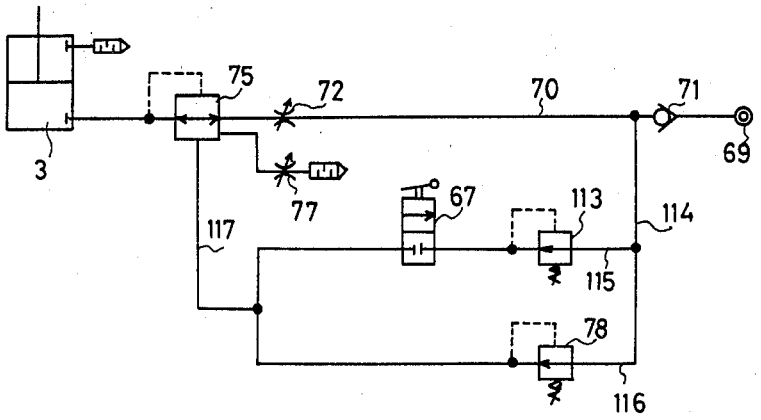
Figure 22:
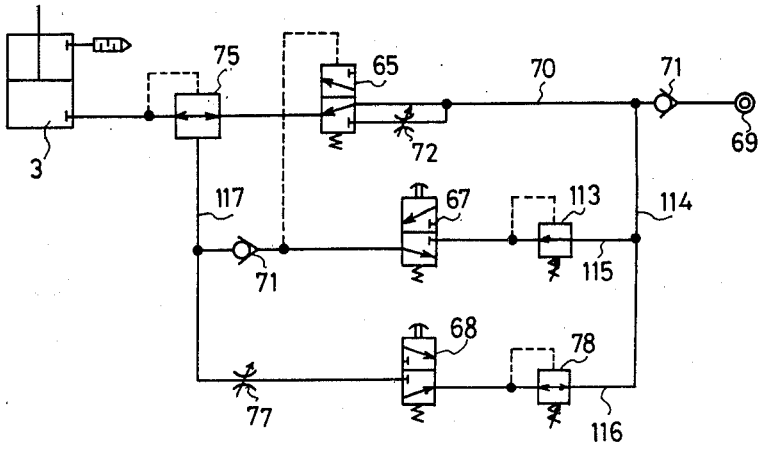

FIGS. 21 and 22 show, respectively, a toggle switch type and a pushbutton type pressure adjusting fluid control circuits. In FIG. 21, there are provided in the conduit 70 interconnecting the pressure source 69 and the cylinder 3, a check valve 71, a throttle valve 72 for regulating the speed of the piston rod 4 of the cylinder 3 moving upwardly and a pilot regulator 75, while a manually operated valve 67 and an no-load adjusting regulator 113 are provided in a path 115 connected to the path 114 branched from the conduit 70 on one hand, and on the other hand an adjusting regulator 78 for the no-load condition is provided on the other path 116. These paths 114 and 116 are additionally connected to the path 117 of the pilot regulator 75. In the case of the arrangement shown in FIG. 22, a manually operated valve 67 for the load condition is provided in the path 115, while a manually operated valve 68 for the no-load condition is provided in the path 116. Operations of these circuits will be self-explanatory.

I claim:

1. A load handling apparatus comprising a lift structure adapted to be moved along a vertical axis, a pair of parallel supporting side plates disposed about said lift structure to rotate in fixed position around said vertical axis, a first horizontal arm extending through a space defined between said supporting side plates, said first horizontal arm being pivotally connected to said lift structure and having one end portion provided with a counterweight and the other end portion pivotally connected to a vertically extending arm, a second horizontal arm extending below and in parallel with said first horizontal arm and having one end portion pivotally connected to said vertical arm, a vertical link arranged between the lift structure and the vertical arm for pivotally connecting said first and second horizontal arms so as to define a parallelogram together with said vertical arm, first guide means provided at the pivotal connection between said vertical link and said second horizontal arm, said first guide means being adapted to be slidably received in a vertical slot formed in each of said supporting side plates and extending perpendicularly to said horizontal slots, actuator means for moving said lift structure in response to a load on said vertical arm to maintain said first and second horizontal arms and said vertical arm and vertical link in parallel relationship during movement with the load and counterweight balanced, comprising a fluid actuated piston and cylinder, a source of fluid under pressure and a fluid circuit for operating said actuating means, said fluid circuit comprising a pilot regulator having a primary flow path for feeding said fluid to said cylinder and a secondary flow path for exhausting said fluid from said cylinder, each path having a manually operable valve and a throttle valve for regulating the velocity of the fluid, at least said primary flow path having a check valve preventing flow of fluid back to said source, said manually operable valves being actuable to maintain the pressure of fluid in the primary and secondary paths equal to the pressure of the fluid in the cylinder.

2. A load handling apparatus according to claim 1 including means for automatically detecting weight on said vertical arm under a loaded condition and under no-load condition thereby to adjust actuating power applied to said lift structure in dependence on the detected weight.

3. A load handling apparatus according to claim 1 including means for decreasing the actuating power applied to said lift structure by an amount exerted externally to said arms in the direction opposite to the moving direction of said lift structure.

4. The apparatus according to claim 1, wherein said actuator means is pivotally connected to said first arm at a point between the connection of said link and said counterweight.

5. The apparatus according to claim 1, wherein said side plates are rotatably mounted on a vertical standard for rotations about the axis thereto and includes means for rotating said side plate 360°.

6. The apparatus according to claim 1, wherein the means for guiding said first and second arms comprises cooperating roller means secured to said arms and slot means formed on said side walls.

7. The apparatus according to claim 1, wherein each of said primary and secondary flow paths includes a pilot valve operable by said manual valve in said primary flow path.

* * * * *